United States Patent [19]

Wakita et al.

[11] Patent Number: 4,867,224

[45] Date of Patent: Sep. 19, 1989

[54] METHOD OF MANUFACTURING CASTINGS OF ACTIVE METAL OR ALLOY THEREOF HAVING UNIDIRECTIONAL SOLIDIFICATION STRUCTURE

[75] Inventors: Saburo Wakita; Juji Hoshi, both of Omiya, Japan

[73] Assignee: Mitsubishi Kinzoku Kabushiki Kaisha, Tokyo, Japan

[21] Appl. No.: 217,496

[22] Filed: Jul. 7, 1988

[30] Foreign Application Priority Data

Jul. 14, 1987 [JP] Japan ..... 62-175482

[51] Int. Cl.[4] ..... B22D 25/00; B22D 2704

[52] U.S. Cl. ..... 164/80; 164/122.1; 164/338.1

[58] Field of Search ..... 164/80, 122.1, 122.2, 164/338.1

[56] References Cited

U.S. PATENT DOCUMENTS

| | | | |
|---|---|---|---|
| 3,714,977 | 2/1973 | Terkelsen | 164/122.1 |
| 4,175,609 | 11/1979 | El Gammal et al. | 164/122.2 |
| 4,665,970 | 5/1987 | Ohno | 164/122.1 |

FOREIGN PATENT DOCUMENTS

| | | | |
|---|---|---|---|
| 60-40664 | 3/1985 | Japan | 164/122.2 |

*Primary Examiner*—Kuang Y. Lin

*Attorney, Agent, or Firm*—Armstrong, Nikaido, Marmelstein, Kubovcik & Murray

[57] ABSTRACT

A method of manufacturing casting of an active metal or alloy having a unidirectional solidification structure is disclosed. This method comprises following steps; supplying an active metal or an alloy in powder form to a mold, preheating the powder in the preheating section of the mold, melting the powder in the narrow melt zone in the mold, moving the melt zone slowly, and cooling the bottom of the melt zone to gradually cause unidirectional solidification.

1 Claim, 1 Drawing Sheet

METHOD OF MANUFACTURING CASTINGS OF ACTIVE METAL OR ALLOY THEREOF HAVING UNIDIRECTIONAL SOLIDIFICATION STRUCTURE

BACKGROUND OF THE INVENTION

1. Field of the Invention

The present invention relates to a method of manufacturing castings having a unidirectional solidification structure of a metal active in the molten state or an alloy thereof (hereinafter referred to as "active metal") such as Ti or a Ti alloy.

2. Prior Art

The method of manufacturing castings having a unidirectional structure such as columnar-crystal or single-crystal castings comprises in general, as shown in FIG. 2, heating a metal to a temperature above the melting point thereof in a high-vacuum atmosphere, teeming molten metal 10 into a mold 3 placed on a water-cooled copper cooling plate 5, and preventing solidification of molten metal 10 by surrounding the mold 3 with a graphite heating element 2 heated by an induction coil 1'.

Cooling the water-cooled copper cooling plate 5 in this state causes columnar crystal grains 9 to be produced upward from said water-cooled copper cooling plate 5 and grow in a single direction while solidifying under the effect of descent of the water-cooled copper cooling plate.

The molten metal 10 charged for manufacturing castings having a unidirectional structure is held at a temperature for a long period of time in the molten state in the mold 3. If said molten metal is a metal active in molten state such as Ti or a Ti alloy, said active metal would erode the mold 3, causing such problems as the reaction with impurities coming from the mold and roughening of the casting surface.

SUMMARY OF THE INVENTION

As a result of extensive studies carried out with a view to solving these problems, the present inventors found the following fact.

By using a raw material to be charged into the mold in powder form, and supplying the powder to be charged to the melting section while preheating so that the preheated powder may be locally melted in the melting section and the resulting molten metal may be brought into contact with the water-cooled copper cooling plate to achieve a unidirectional solidification structure, erosion of the mold can be minimized and the reaction with impurities coming from the mold can be reduced since metal powder mostly comes into touch with the mold and the metal is in the molten state only for a limited period of time over a short distance.

The present invention is based on this finding and provides a method of manufacturing castings of an active metal having a unidirectional solidification structure, which comprises the steps of:

supplying an active metal in powder form to a mold;

by the use of a furnace provided with systems of heating unit comprising a preheating section and a melting section having a narrow melt zone, preheating the powdery active metal in said mold of said preheating section, and causing same to slowly travel through said melt zone while locally melting same in said melting section; and cooling, on the other hand, the thus locally melted metal under said melt zone to gradually cause unidirectional solidification.

DETAILED DESCRIPTION OF THE INVENTION

In the present method of manufacturing castings of an active metal having a unidirectional structure, the individual requirements are as follows.

The width of the melt zone should preferably be the smallest possible, but a width of from 10 to 20 mm is necessary for obtaining a unidirectional solidification structure.

The preheating width should also preferably be the smallest possible so as not to accelerate sintering, but should be at least 50 mm.

The active metal may be Ti, an alloy thereof, Cr or an alloy thereof. The active metal powder should have a particle size of from 100 to 200 mesh and the shape thereof should preferably be the closest possible to a sphere.

In order to obtain a unidirectional solidification structure under special circumstances as described above, it is the common practice to use a descending speed of the mold of from 100 to 300 mm per hour. With a view to keeping a melt zone of from 10 to 20 mm, however, the descending speed of the mold should preferably be from 100 to 200 mm per hour.

While it is desirable to use an induction heating coil for heating the mold, the means for heating is not particularly limited to an induction coil but any other means for heating may be adopted.

1: induction heating coil (for heating)
1': induction heating coil (for holding temperature)
2: graphite heating element,
3: mold,
4: induction heating coil (for melting),
5: water-cooled copper cooling plate,
6: water-cooled coil for cooling,
7: raw material powder,
8: melt zone,
9: columnar crystal grains,
10: molten metal.

EXAMPLE

Now, the present invention is described more in detail with reference to an example.

Figure 1:
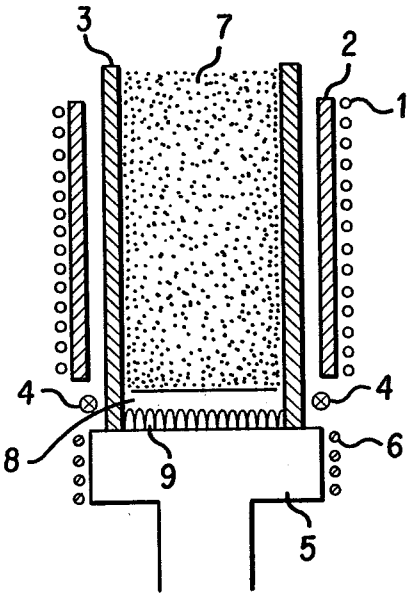
FIG. 1 is a schematic cross-sectional view illustrating a melting furnace used for manufacturing active metal castings having a unidirectional solidification structure in the present invention.

FIG. 1 is a schematic cross-sectional view of the apparatus used for the application of the present invention. In FIG. 1, 1 is an induction heating coil (for heating; 2 is a graphite heating element; 3 is a mold; 4 is an induction heating coil (for melting); 5 is a water-cooled copper cooling plate: 6 is a water-cooled coil for cooling; 7 is a raw material powder; 8 is a melt zone; and 9 are columnar crystal grains.

Powder of 50% Ni-Ti alloy having a particle size of 200 mesh was charged into an alumina mold 3 in the apparatus shown in FIG. 1 placed in an ordinary vacuum atmosphere. The alumina mold 3 had a diameter of 10 mm and a length of 100 mm. The mold 3 was heated by means of the induction heating coil 1 and the graphite heating element 2 to a temperature of 1,200° C. and held at this temperature. Then, the melting section in the melt zone was heated with the induction heating coil 4 to 1,600° C. to melt the preheated 50% Ni-Ti alloy powder.

The water-cooled copper cooling plate 5 in contact with the molten 50% Ni-TI alloy was, on the other hand, cooled by the water-cooled coil for cooling 6 and a unidirectional solidification structure was caused to grow while causing the thus cooled water-cooled copper cooling plate 5 and the mold 3 to descend at a speed of 100 mm per hour, to manufacture a casting having the unidirectional solidification structure.

The casting was removed to investigate the casting surface thereof. The result revealed successful manufacture of a casting of columnar crystal grains having a reaction layer with the mold thinner than 0.5 mm.

Figure 2:
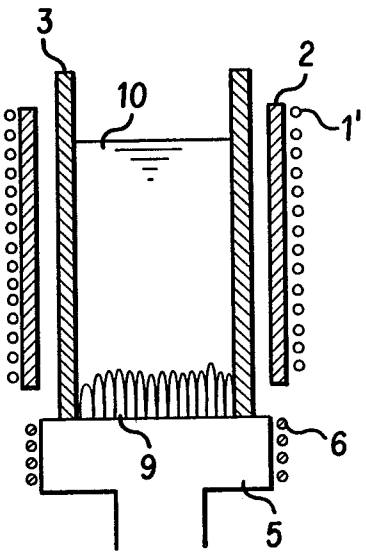
FIG. 2 is a schematic cross-sectional view illustrating a melting furnace used for manufacturing conventional active metal castings having a unidirectional solidification structure.

For comparison purposes, by the use of the casting apparatus shown in FIG. 2, 50% Ni-Ti alloy melted at a temperature of 1,600° C. was charged in an ordinary vacuum atmosphere into an alumina mold 3 having a diameter of 10 mm and a length of 100 mm. Molten metal 10 in the mold 3 was held at a temperature of 1,600° C. with the induction heating coil (for holding temperature).

The mold 3 and the water-cooled copper cooling plate 5 were caused to descend at a speed of 200 mm per hour while cooling the water-cooled copper cooling plate 5 with the cooling coil 6. There was observed the reaction between the molten metal and the mold, resulting in a reaction layer thicker than 3 mm on the surface of the casting having a unidirectional structure.

In the present invention, in which the raw material in contact with the mold is mostly in powder form and the molten metal is in contact with the mold over a very limited area for a very short period of time, it is possible, when casting a metal active in molten state such as Ti or an alloy thereof, to minimize erosion of the mold by the active metal, and hence to reduce reaction with impurities from the mold, thus permitting manufacture of active metal castings having a unidirectional solidification structure with a more beautiful casting surface than in the prior art.

When applying the method of the present invention, for example, to the manufacture of artificial bones made of Ti or a Ti alloy, there is available an effect of permitting manufacture of excellent artificial bones high in resistance to alternate stress in human bodies with limited casting surface roughness and entrapped impurities because of the unidirectional solidification structure, in addition to such inherent advantages of Ti or a Ti alloy as a light weight, high strength and excellent corrosion resistance.

What is claimed is:

1. A method of manufacturing from an active metal or an alloy thereof a casting having a unidirectional solidification structure, comprising the steps of:

(a) supplying said active metal or alloy thereof in powder form to a mold which is vertically movable inside a system of heating means;

(b) controlling said system of heating means so as to define an upper heated section wherein the temperature is below the temperature at which said metal or alloy thereof melts, and a lower heated section wherein the temperature is sufficiently high to melt said metal or alloy thereof, whereby the metal or alloy thereof which is in said lower heated section is melted, wherein the height of said lower heated section is from 10 mm to 20 mm;

(c) providing said mold at its bottom with cooling means, whereby said melted metal or alloy thereof is caused to solidify; and (d) progressively moving said mold downwardly inside said system of heating means, so as to continuously advance the solidification of said metal or alloy thereof upwardly from the bottom of the mold, whereby unidirectional solidification of said metal or alloy thereof is obtained.

* * * * *